United States Patent [19]

Yokoyama

[11] Patent Number: 4,887,476

[45] Date of Patent: Dec. 19, 1989

[54] SMALL ENGINE PROVIDED WITH SELF STARTING MOTOR

[75] Inventor: Yukio Yokoyama, Chiba, Japan

[73] Assignee: Tanaka Kogyo Co., Ltd., Chiba, Japan

[21] Appl. No.: 243,674

[22] Filed: Sep. 13, 1988

[51] Int. Cl.[4] ..... F02N 15/02

[52] U.S. Cl. ..... 74/7 E

[58] Field of Search ..... 74/7 E, 7 C, 7 A, 7 R, 74/6; 192/104 B; 123/179 CC, 179 SE

[56] References Cited

U.S. PATENT DOCUMENTS

| | | | |
|---|---|---|---|
| 2,939,448 | 6/1960 | Hansen | 192/42 |
| 3,428,034 | 2/1969 | MacAfee et al. | 74/7 R |
| 4,483,279 | 11/1984 | Köhler et al. | 123/179 SE X |
| 4,582,030 | 4/1986 | Reese | 74/6 X |

*Primary Examiner*—Leslie A. Braun
*Assistant Examiner*—Janice E. Chartoff
*Attorney, Agent, or Firm*—Frishauf, Holtz, Goddman & Woodward

[57] ABSTRACT

A small engine provided with a self starter motor is suitable for use as a driving mechanism for hand-held or back-carried machines such as cleavers. As the engine is provided with a reduction drive gear loosely inserted over a cylindrical support concentrically provided with a crankshaft, and is so constructed that the rotation of the shelf starter motor is transmitted to the crankshaft via the reduction drive gear and an engagement/disengagement mechanism using centrifugal force, it is possible to improve the durability thereof and to simplify assembly operation.

3 Claims, 2 Drawing Sheets

SMALL ENGINE PROVIDED WITH SELF STARTING MOTOR

BACKGROUND OF THE INVENTION AND RELATED ART STATEMENT

This invention is related to a small engine provided with a self starting motor, and more particularly to an improvement in the small engine provided with a self starter suitable for use as a device to drive hand-held or back-carried machines such as cleavers, blowers, or chain saws.

As a driving device for hand-held or back-carried machines such as cleavers, there was developed in the art a small sized engine provided with a self starter engine which is compact and easy-to-handle at the same degree as the conventional type small engines provided with a recoil starter for the benefit of the consumer public.

This type of small engine with a self starter is so structured that a reduction drive gear is loosely inserted over a crankshaft via bearings, a pinion of the self starter is engaged with the reduction drive gear, and a rotating body axially mounted on the crankshaft and the reduction drive gear are engaged/disengaged by the centrifugal force in order to effect or release the power transmission.

Such small engine as above mentioned, however, is detrimental in that excessive damage occurs to the bearings provided between the reduction drive gear and the crankshaft which are constantly rotating when the engine is being driven and that errors in processing or assembly of the crankshaft, the crankcase or the fan casing induce misalignment between the pinion of the motor and the reduction drive gear to result in serious damages.

SUMMARY OF THE INVENTION

The present invention therefore aims at offering a small engine provided with a self starter motor wherein a crankshaft, a pinion of the motor is engaged with the reduction gear, and a rotating body axially mounted on the crankshaft and the reduction drive gear are engaged/disengaged by the centrifugal force to facilitate the processing and assembly of the component parts and to improve the durability by providing a cylindrical support member concentrically with the crankshaft, and loosely inserting the reduction drive gear over the cylindrical support member.

In such a construction, the cylindrical support may be provided projectingly on the inner surface of the fan casing or the outer surface of the crankcase to allow efficient use of the space within the engine.

THE PREFERRED EMBODIMENTS OF THE INVENTION

Preferred embodiments of the small engine provided with a self starter in accordance with the present invention are now described in detail by referring to attached drawings.

Figure 1:
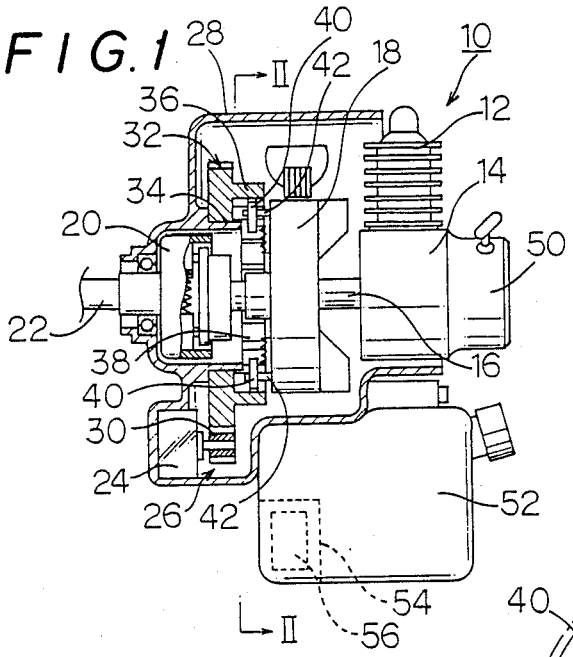
FIG. 1 is an explanatory cross sectional view showing a preferred embodiment of the present invention small engine provided with a self starter engine.

In FIG. 1, a small engine 10 provided with a self starter in accordance with the present invention is further provided with a rotator body such as a magnetic rotor 18 axially mounted on a crankshaft 16 extending from a crankcase 14 provided beneath an engine main body 12, and an output axis 22 at the end of the crankshaft 16 via the centrifugal clutch 20. There are further provided a starter mechanism 26 including a self starter motor 24 between the magnetic rotor 18 and the centrifugal clutch 20, a fan casing 28 housing the magnetic rotor 18, the starter mechanism 26 and the centrifugal clutch 20.

The starting mechanism 26 is provided with a pinion 30 of the self starter 24 inside the fan casing 28 and a reduction drive gear 32 which engages the pinion 30, the reduction drive gear 32 being loosely and rotatably inserted over a cylindrical support member 34 projected concentrically with the crankshaft 16 inside the fan casing 28.

On one side of the reduction drive gear 32 is provided a cylindrical projection member 36 concentrically with the crankshaft 16, the cylindrical projection 36 being cut with a plurality of gears 38 on the inner periphery thereof.

On the side opposing the cylindrical projection member 36 of the magnetic rotor 18 are provided a pair of engagement/disengagement cams 40, 40 in a symmetrical relation to shafts 42, 42. At the end of the cams 40 are further provided an engagement/disengagement means 44 and a weighting means 46, said means 44 being resiliently pressed against the engagement gears 38 of the cylindrical projection member 36 under the tension of a tensile spring 48 placed between the shaft 42 and the weighting means 46. (See FIG. 2).

In FIG. 1, references numerals 50 and 52 denote a recoil starter and a fuel tank respectively. There is provided a recessed chamber 54 with a cover at a predetermined position on the outside of the ful tank 52, and a battery 56 for driving the self starter via a cushioning material such as soft rubber inside the chamber 54. Such a structure is useful in reducing the size of the engine as a whole.

The small engine thus constructed in accordance with the present invention starts the motor 24 via a switch (not shown), transmits the rotating force thereof to the reduction drive gear 32 via the pinion 30, and the rotation of the reduction drive gear 32 to the crank via the gears 38 of the cylindrical projection 36, the engagement/disengagement means 44 of the cams 40, the magnetic rotor 18, and the crankshaft 16, to thereby start the engine.

After the engine is started, power supply to the motor 24 is suspended by manipulating the switch. In the above state, the gears 38 and the engaging/disengaging members 44 of the cams 40 are engaged with each other by the tension of the tensile spring 48, so that the rotation of the crankshaft 16 is then transmitted in the reverse order of the magnetic rotor 18, the reduction drive gear 32 and the pinion 30, to leave the motor 24 idling.

Figure 2:
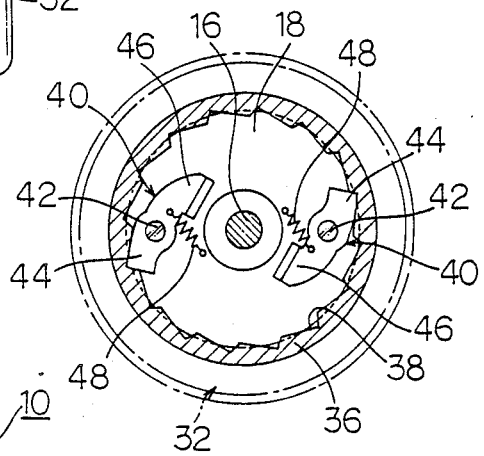
FIG. 2 is an explanatory cross sectional view along the line II—II of FIG. 1 showing the small engine provided with a self starting motor.

When the rotation of the engine main body or crankshaft 16 reaches the predetermined number, and the centrifugal force acting on the weighting means 46, 46 of the cams 40, 40 becomes larger than the tensile force of the tensile springs 48, 48, these cams 40, 40 rotate in a direction counterclockwise to the shafts 42, 42 as shown in FIG. 2. The engagement/disengagement means 44 of the cams 40 then become released from the gears 38 of the reduction drive gear 32 to thereby shut off the power transmission to the reduction drive gear 32, and to cause the motor 24 to cease its movement spontaneously.

It is preferable in this case to process the outer edges of the weighting means 46, 46 in arcs as shown in the present embodiment so as to prevent damages to the gears 38 by contact of the weighting means 46, 46 therewith which began a counterclockwise rotation by the centrifugal force.

When the engine stops, the cams 40, 40 rotate in the direction clockwise to the shafts 42, 42 when the tensile force of the tensile springs 48, 48 becomes larger than the centrifugal force acting on the weighting means 46, 46, to thereby re-engage the engaging/disengaging means 44, 44 with the gears 38. The motor 24 and the crankshaft 16 are thus in constant contact via the starter mechanism 26 while the engine is suspended. It is therefore possible to secure starting of the engine easily by following the same operation.

Figure 3:
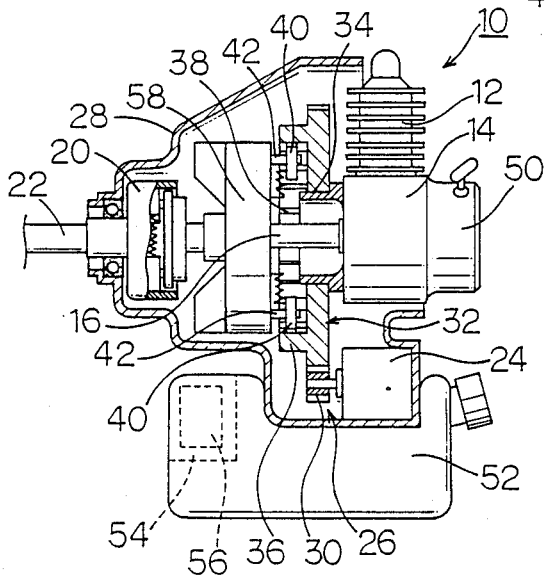
FIGS. 3 to 5 are explanatory cross sectional views showing preferred embodiments of the present invention small engine provided with a self starter engine respectively.

FIG. 3 shows another embodiment of a small engine provided with a self starter in accordance with the present invention wherein a cylindrical support 34 is integrally provided on the outside of a crankshaft 14, and the gears 38 provided on a reduction gear 32 and engaging/disengaging cams 40, 40 provided on a fly wheel 58 are engaged/disengaged by the centrifugal force.

Figure 4:
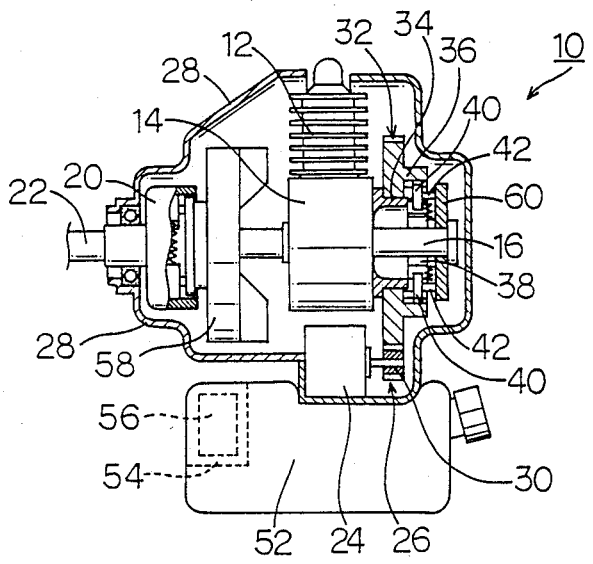

FIG. 4 shows still another embodiment of this invention small engine provided with a self starter wherein a cylindrical support 34 is integrally provided on the outside of a crankcase 14 placed opposite to an output shaft 22 or the position where a recoil starter is provided in FIG. 1, and gears 38 provided on a reduction drive gear 32 and engaging/disengaging cams 40, 40 provided on a rotating piece 60 fixed to an end of a crankshaft 16 are engaged/disengaged by the centrifugal force.

Figure 5:
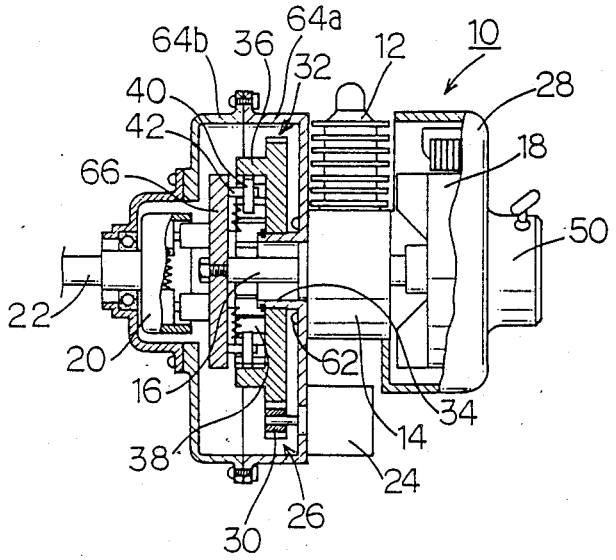

FIG. 5 shows a further embodiment of the present invention small engine with a self starter provided with a catch 62 which is used to fix a gear case 64a on the outside of a crankcase 14, a cylindrical support 34 formed on the gear case 64a, gears 38 formed on a cylindrical projection 36 of a reduction drive gear 32 which is loosely inserted over the cylindrical support 34, engagement/disengagement cams 40, 40 on the inside of a plate for mounting a centrifugal clutch 66 as a rotating body axially supported by a crankshaft 16, these cams 40, 40 and the gear 38 being engaged/disengaged by the centrifugal force.

In all these embodiments as well as in Embodiment 1, connection or release of power transmission between the reduction drive gear and the crankshaft can be performed smoothly, and by changing or optimally arranging the components of the engine, the size thereof may be reduced considerably. In the embodiment shown in FIG. 5, mounting/ dismounting of the gear case is easily performed so as to simplify maintenance of the starter mechanism and the centrifugal clutch.

As mentioned above, the small engine provided with a starter motor in accordance with the present invention not only improves durability thereof with less damage to the bearings as the reduction drive gear is loosely inserted over the cylindrical support provided concentrically with the crankshaft, but also enables precise engagement of the reduction drive gear and the pinion as processing and assembly of the crankshaft, the crankcase and the fan casing become easier and simpler, thereby preventing damage to the engagement members, etc. as much as possible.

The above going description was given in respect of the preferred embodiments of the small engine with a starter in accordance with the present invention, but it should be understood that the present invention is in no way limited to these embodiments, and various changes and modifications in design can be made within the scope of this invention without departing from the spirit of the present invention.

What is claimed is:

1. A small engine provided with a self starter comprising a reduction drive gear provided in a freely rotatable fashion in surrounding coaxial relation to a crankshaft, a pinion of the starter engaged with the reduction drive gear, rotator means axially mounted on the crankshaft and engaged with the reduction drive gear, a cylindrical support provided concentrically with and in surrounding relation to the crankshaft, the reduction drive gear being loosely inserted over the cylindrical support.

2. The small engine provided with a self starter as claimed in claim 1 wherein the cylindrical support is extendingly provided on an inner surface of a fan casing.

3. A small engine provided with a self starter comprising a reduction drive gear provided in a freely rotatable fashion in respect of a crankshaft, a pinion of the starter engaged with the reduction drive gear, rotator means axially mounted on the crankshaft and engaged with the reduction drive gear, a cylindrical support provided concentrically with the crankshaft, the cylindrical support being extendingly provided on an outer surface of a crankcase, and the reduction drive gear being loosely inserted over the cylindrical support.

* * * * *